US007216381B1

(12) United States Patent
Setzer

(10) Patent No.: US 7,216,381 B1
(45) Date of Patent: May 15, 2007

(54) PORTABLE PRIVACY ENCLOSURE

(76) Inventor: Ingrid Setzer, 9041 Pineapple Rd., Fort Myers, FL (US) 33912

( * ) Notice: Subject to any disclaimer, the term of this patent is extended or adjusted under 35 U.S.C. 154(b) by 46 days.

(21) Appl. No.: 11/036,547

(22) Filed: Jan. 14, 2005

Related U.S. Application Data

(60) Provisional application No. 60/536,600, filed on Jan. 14, 2004.

(51) Int. Cl.
*A47G 9/06* (2006.01)

(52) U.S. Cl. ..... 5/418; 5/417; 5/512; 256/26; 160/135

(58) Field of Classification Search ..... 5/417, 5/418, 420, 512, 99.1, 6; 256/25, 26, 29; 4/587; 119/474, 498, 499, 513, 514; 220/6, 220/4.28; 135/117, 143; 160/135; 52/70, 52/71

See application file for complete search history.

(56) References Cited

U.S. PATENT DOCUMENTS 2,950,484 A * 8/1960 Jaffe ..... 5/98.1
3,023,753 A * 3/1962 Wheless ..... 607/95
5,085,212 A * 2/1992 DeCosta ..... 5/417
5,115,524 A * 5/1992 Antosko ..... 5/99.1
6,119,288 A * 9/2000 Hendrickson ..... 5/99.1
6,705,338 B2 * 3/2004 Zheng ..... 135/117
6,981,605 B2 * 1/2006 Kasuya et al. ..... 220/6
2004/0112895 A1 * 6/2004 Bartasevich et al. ..... 220/4.28

* cited by examiner

*Primary Examiner*—Daniel P. Stodola
*Assistant Examiner*—Michael P. Ferguson
(74) *Attorney, Agent, or Firm*—William E. Noonan

(57) ABSTRACT

A portable privacy enclosure for sunbathing and other applications includes a bottom panel for engaging the ground or other underlying surface. A first pair of side panels are foldably attached to one longitudinal side of the bottom panel and a second pair of side panels are similarly attached to an opposite side of the bottom panel. A pair of opposing end panels are foldably attached to respective ends of the bottom panel. Each end panel extends between a respective opposing pair of the side panels. Fasteners are provided for releasably interconnecting each adjoining pair of vertical panels to hold the enclosure in an assembled condition.

18 Claims, 5 Drawing Sheets

PORTABLE PRIVACY ENCLOSURE

RELATED APPLICATION

This application claims the benefit of U.S. Provisional Patent Application Ser. No. 60/536,600 filed Jan. 14, 2004.

FIELD OF THE INVENTION

This invention relates to a collapsible, portable privacy enclosure and, more particularly, to a product featuring a plurality of releasably interconnected side walls that function as privacy panels and which are foldable into a conveniently transportable unit.

BACKGROUND OF THE INVENTION

Sunbathers often require some degree of privacy. Currently, a number of screens and privacy panels are available for sunbathing use. These products often utilize a fairly bulky and complex construction, which is difficult to assemble and disassemble. Moreover, most of the known products are not conveniently portable. A need exists for an improved sunbathing privacy screen which is convenient to set up and break down, easily stored and readily transportable.

SUMMARY OF THE INVENTION

It is therefore an object of the present invention to provide a portable enclosure that effectively protects a sunbather's or other user's privacy.

It is a further object of this invention to provide a privacy enclosure employing a lightweight and yet extremely durable construction.

It is a further object of this invention to provide a privacy enclosure that is extremely convenient to assemble and disassemble.

It is a further object of this invention to provide a privacy enclosure that is readily collapsible into a compact condition wherein the product may be conveniently stored or transported.

It is a further object of this invention to provide a portable enclosure that effectively resists unintended collapsing so that improved privacy is provided for a sunbather or other person using the product.

This invention features a portable privacy enclosure including a bottom panel for engaging an underlying supportive surface such as the ground, a porch floor or deck, or an indoor floor. There are a first pair of side panels foldably attached to the bottom panel along a first side edge thereof, and a second pair of side panels foldably attached to the bottom panel along an opposite second side edge thereof. Respective fasteners releasably interconnect the first pair of side panels to one another and the second pair of side panels to one another. There is a first end panel foldably connected to the bottom panel along a forward edge of the bottom panel that extends between the respective side edges of the panel. A second end panel is foldably connected to the bottom panel along an opposite rearward end of the bottom panel that extends between the respective sides of the bottom panel. Each of the end panels is releasably fastened to a respective one of the first side panels and a respective one of the second side panels. The enclosure has an open upper end that permits sun to illuminate the inside of the enclosure. Each of the side and end panels includes an opaque material that affords privacy to a person lying within the enclosure with the panels fastened to one another in an assembled condition. Between uses, the adjoining side and end panels are unfastened from one another and collapsed sequentially onto the bottom panel. The entire assembly is then folded into a compact and portable condition.

In a preferred embodiment, the panels comprise a fabric or mesh material. Each of the side and end panels may be bounded by a square or otherwise rectangular frame, which may be composed of wire, tubing, plastic, wood or fiberglass. With each of the side and end panels in a collapsed or folded condition, the bottom panel may be folded in half so that the product is placed in its portable condition. A handle may be utilized for carrying the collapsed enclosure. The fasteners for the adjoining panels may comprise leather straps or alternative means for fastening such as Velcro™, snap fasteners, hooks and grommets, etc.

DETAILED DESCRIPTION OF PREFERRED EMBODIMENTS

Other objects, features and advantages will occur from the following description of preferred embodiments and the accompanying drawings, in which.

Figure 1:
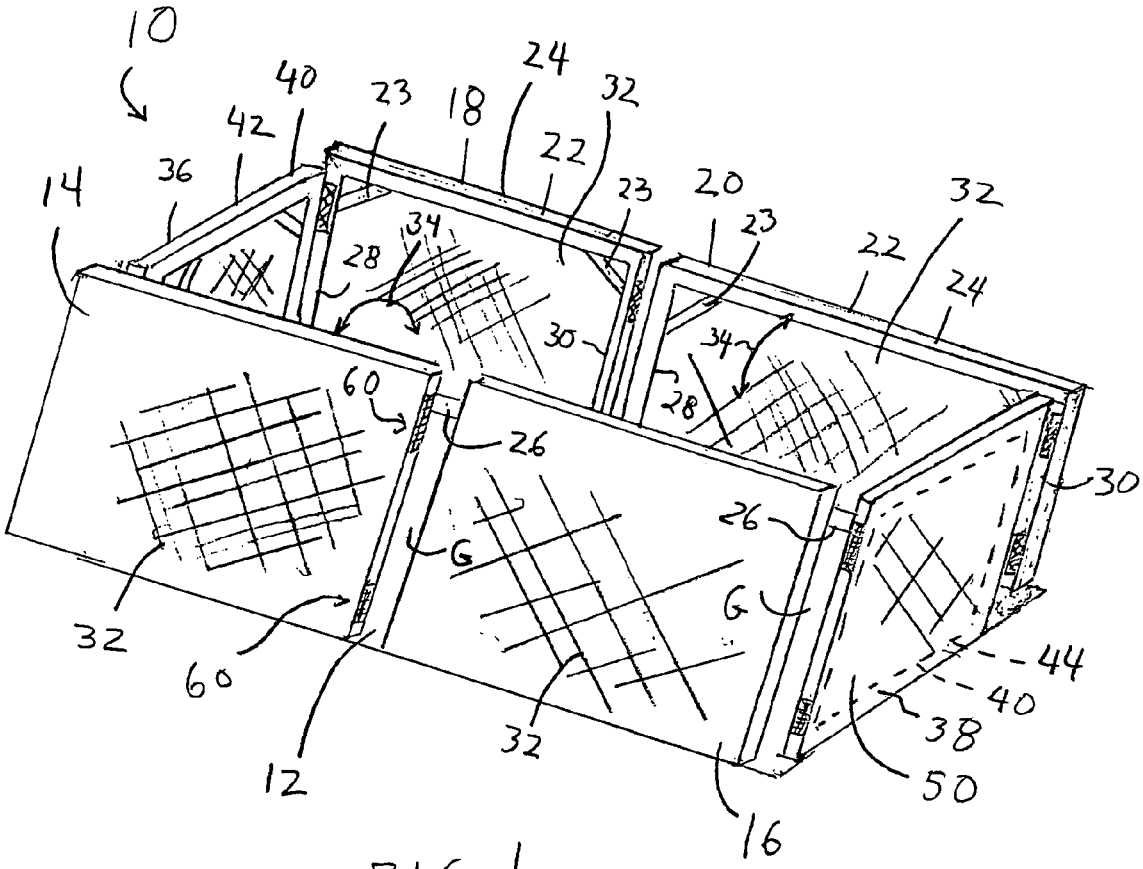
FIG. 1 is a perspective view of a preferred privacy enclosure according to this invention.
Figure 2:
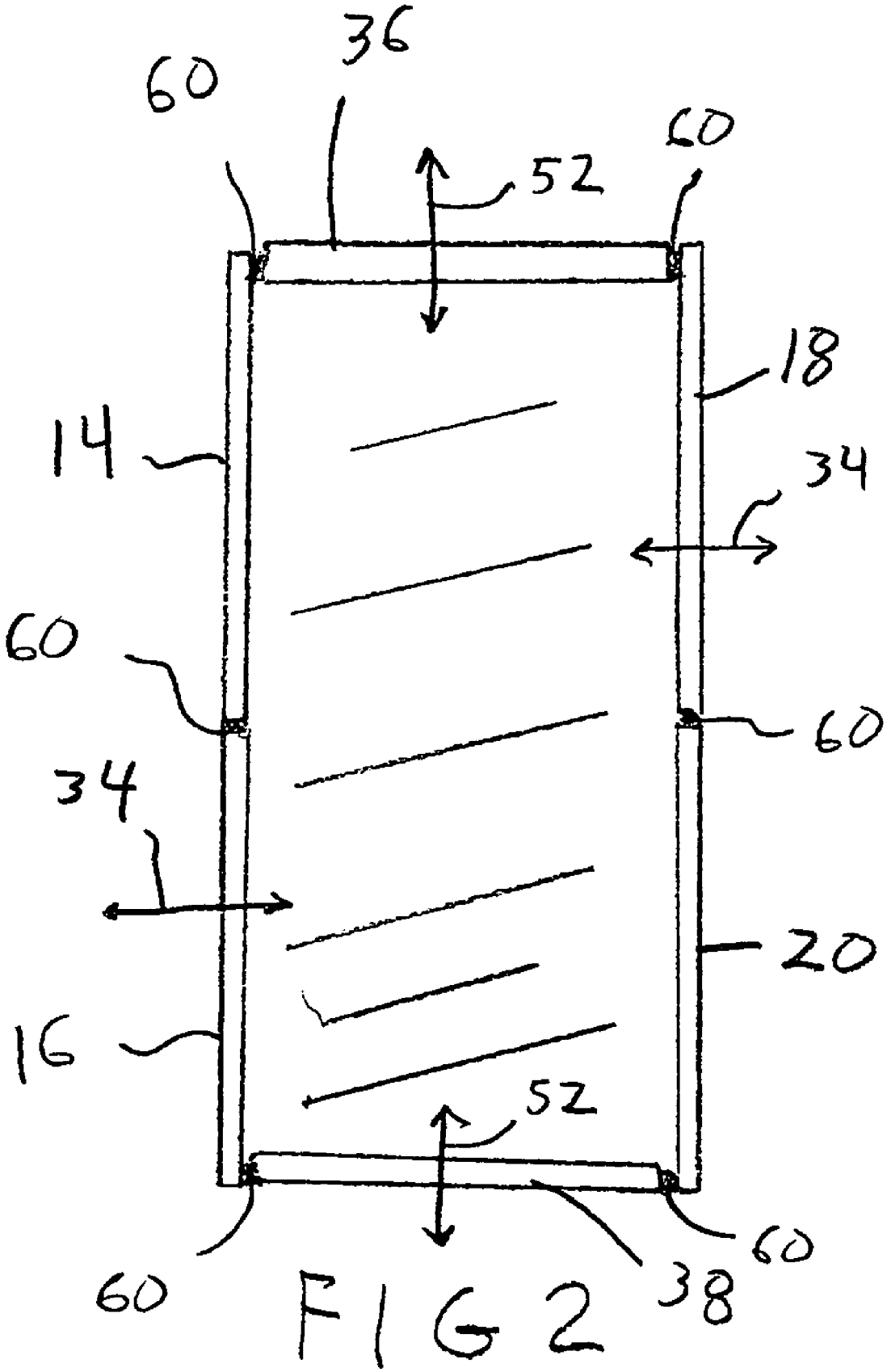
FIG. 2 is a top plan view of the enclosure.
Figure 3:
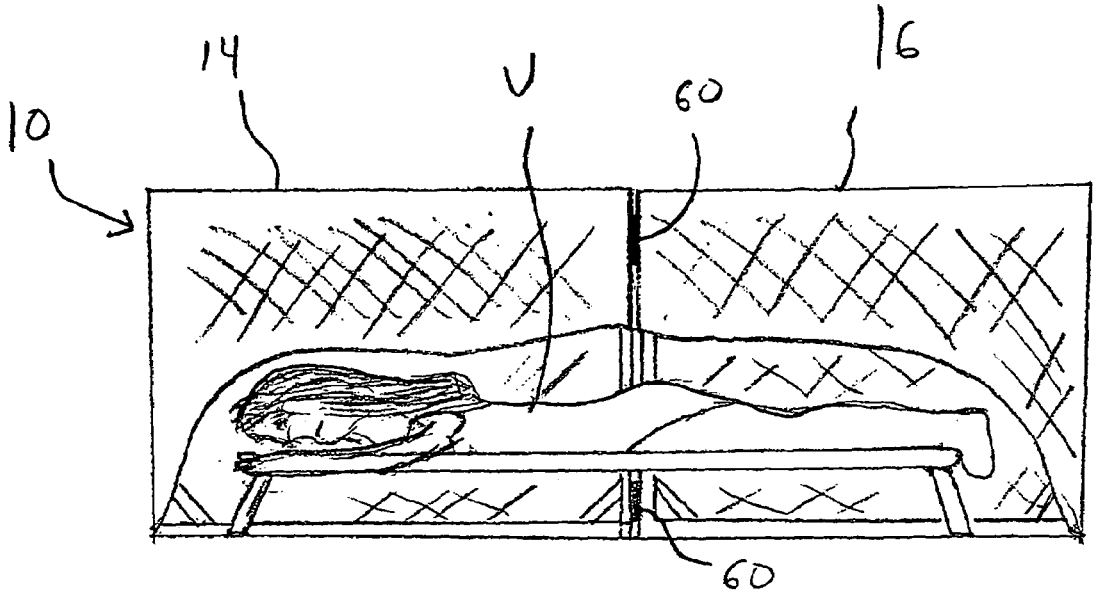
FIG. 3 is an elevational side view of the enclosure in an assembled condition for guarding the privacy of a person lying within the enclosure.
Figure 4:
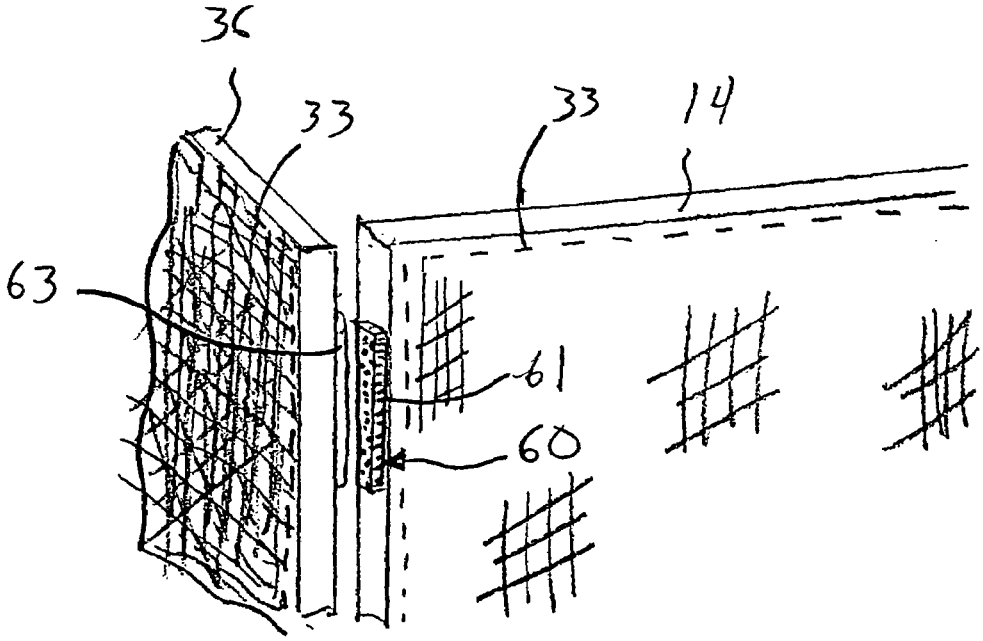
FIG. 4 is a fragmentary view of one corner of the enclosure particularly indicating a hook and loop fastener used to releasably interconnect the adjoining panels.

There is shown in FIGS. 1–3 a portable privacy enclosure 10 designed for use in sunbathing and other activities in which the user desires at least some degree of privacy. Enclosure 10 is designed primarily for outdoor use and is intended to be set up on the ground (e.g. typically on a grass or sand underlying surface) or alternatively on a pool, patio or porch floor or deck. It should be noted, however, that the privacy enclosure may also be used indoors in situations where the user desires improved privacy (e.g. in airport lobbies). The enclosure includes an open top and a bottom or floor panel 12 that is a flexible sheet typically composed of a fabric such as canvas or some other type of durable mesh material. Lightweight wood or plastic may also be used. A first pair of side panels 14 and 16 are foldably connected to bottom panel 12 along one of the longitudinal (e.g. typically head to toe) sides. Likewise, a second pair of side panels 18 and 20 are foldably or collapsibly connected to an opposite longitudinal side of the floor panel. As best shown in FIG. 1, each of the side panels includes a square or otherwise rectangular frame 22 having upper and lower horizontal pieces 24 and 26, as well as vertical side pieces 28 and 30 extending between pieces 24 and 26. A gusset or bracket 23 comprising a strip of wood or plastic is connected at each corner of frame 22 to strengthen the frame. Canvas, wire mesh or other opaque fabric screening material 32 is mounted to each frame 22. For example, fabric 32 may be stapled, tacked or otherwise fastened to the frame. In certain embodiments, each frame may include a pair of conforming segments that are pressed together or sandwiched about the fabric piece 32. Each of the fabric segments 32 may be unitarily connected to bottom panel 12. Alternatively, the bottom panel may be fastened by stitching or otherwise (see stitching 33 in FIG. 4) to lower horizontal strips 26 of frames 22 in a manner similar to which the side panel fabric segments 32 are attached to the frame 22. In any event, each of the side panels 14, 16, 18 and 20 is foldable relative to bottom panel 12, as indicated by double-headed arrows 34.

A similar pair of opposing end panels 36 and 38 are attached foldably in a like manner to respective forward and rearward ends of lower panel 12. Each of end panels 36 and 38 includes a square frame 40 comprising a pair of parallel upper and lower horizontal pieces 42 and 44, as well as a pair of parallel vertical pieces 46 and 48 that interconnect horizontal pieces 42 and 44. A piece of fabric 50 is mounted within frame 40 in a manner similar to that used to mount fabric 32 within frames 22, i.e. by stapling, Velcro™, adhesives, tacks, etc. Once again, fabric segments 50 may be connected unitarily or in one piece to bottom panel 12. Alternatively, pieces 50 used in end panels 36 and 38 may be separate from bottom panel 12 and the bottom panel may be secured at its respective ends to lower pieces 44 of respective end panels 36 and 38. As with the side panels, end panels 36 and 38 are foldable or collapsible as indicated by double-headed arrows 52 in FIG. 2.

To erect or assemble enclosure 12, the collapsible side and end panels 14, 16, 18, 20, 36 and 38 are raised into the generally vertical, elevated or upright condition shown in FIGS. 1–3. The adjoining panels are fastened together by various means. For example, as shown in FIGS. 1–3 and more particularly in FIG. 4, each pair of adjoining side and end panels may be fastened together by means a pair of two-part hook and loop (e.g. Velcro™) fasteners 60. Typically, a hook component 61 is carried along an edge of the frame in one of the panels; a complementary piece of loop material 63 is similarly carried by a corresponding mating surface of the frame of an adjacent panel. Components 61 and 63 are selectively interengaged to secure together the adjacent panels and hold those panels in an upright condition, which is best depicted in FIGS. 1 and 3. A pair of fasteners 60 are typically formed along each of the interengaging surfaces of the adjacent panels. More particularly, the corresponding individual fastening components are formed at equivalent heights along the respective adjoining panels.

As best illustrated in FIG. 1, bottom panel 12 has a length that is somewhat greater than the total length of the aligned side panels 14 and 16 (or analogously panels 18 and 20). By the same token, bottom panel 12 is wider than end panels 36 and 38. As a result, when the enclosure is initially set-up, as shown in FIG. 1, and the side and end panels are raised into an upright condition, a gap G is formed between each adjacent pair of panels. In order to secure the panels together, the panels are manipulated by moving the adjacent panels into interengagement such that the corresponding hook and loop components carried by the respective panels are interengaged. The flexible sheet material comprising bottom panel 12 allows the bottom panel to conveniently collapse so that the adjacent panels may be moved easily into engagement with one another. For example, in FIG. 1 panels 14 and 16 are slid or otherwise pushed into abutting end-to-end interengagement such that the panels are secured together by hook and loop fasteners 60 in the manner shown in FIGS. 2 and 3. This operation is performed for each adjacent pair of side and end panels. For example, in FIG. 4, loop component 63 carried by end panel 36 is pushed into interengagement with hook component 61 carried by side panel 14. The extra material of bottom panel 12 located between each end panel and its respective side panels once again allows the bottom panel to collapse so that the panels may be moved easily into an interengagement with one another. When all of the panels have been fastened together, the enclosure 10 is fully erected in the upright condition depicted in FIGS. 2 and 3.

Figure 4A:
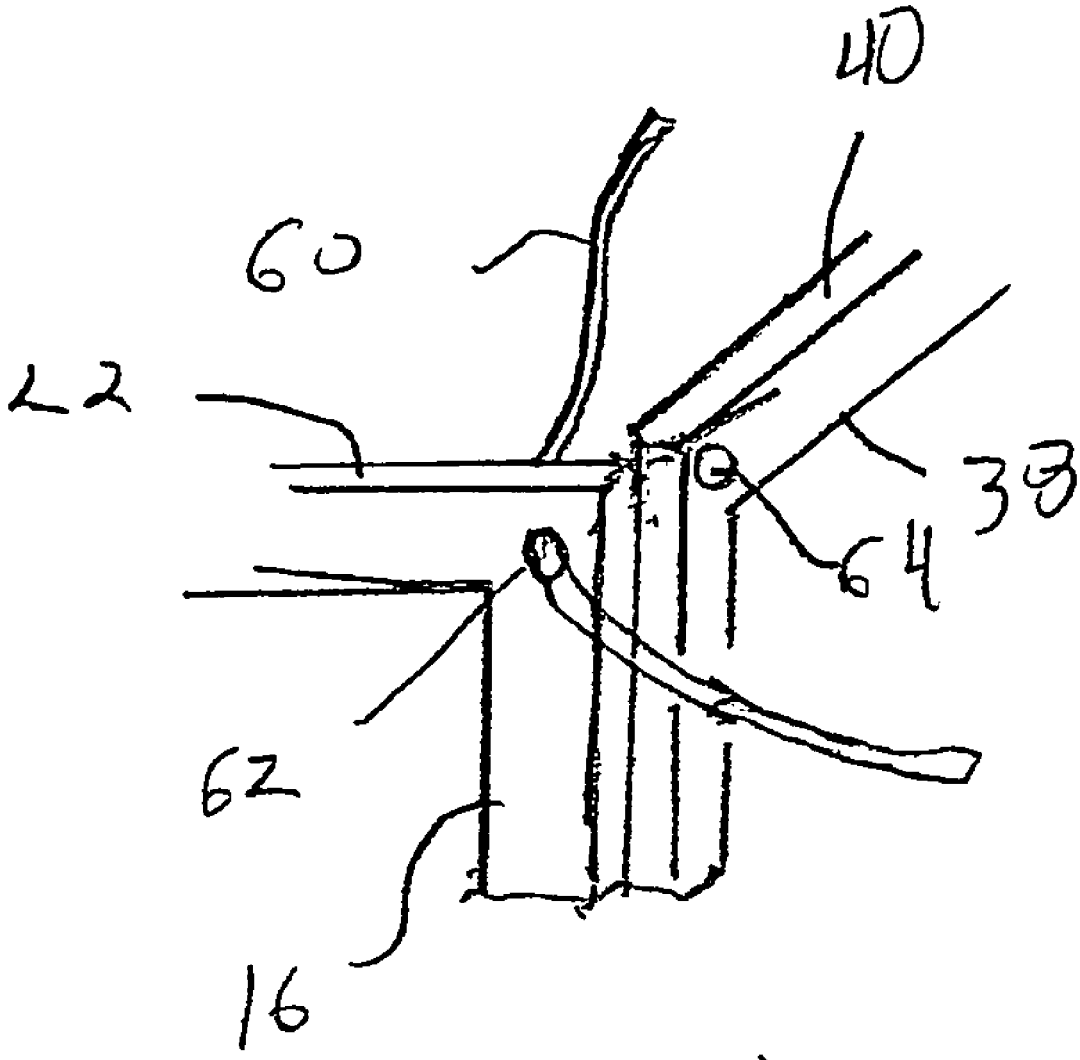
FIG. 4A is a fragmentary view of one corner of an alternative enclosure according to this invention, which utilizes leather strip fasteners to secure adjoining panels together.

An alternative means for fastening the adjacent panels together includes one or more straps as depicted in FIG. 4A. Typically, the strap is mounted through an opening 62 in one corner of each of the panel frames 22 and 40. In FIG. 4A, the junction between a representative side panel 16 and a representative end panel 38 is shown. The strap 60 extends through an opening 62 in one corner of frame 22 of panel 16. With both panels 16 and 38 in a raised condition, strap 60 is interengaged with a complementary hole 64 in the adjoining corner of frame 40 of panel 38. After strap 60 is inserted through hole 64, the strap is tied such that the adjoining panels 16 and 38 are fastened together and support each other in an upright condition. This type of connection may be used to interconnect both the adjoining side panels and each adjoining pair of side and end panels in a manner analogous to the hook and loop fasteners depicted in FIGS. 1–3. It should also be understood that a wide variety of alternative fastening means may be employed. For example, the adjoining panels may be held in place in an assembled condition by assorted types of clips, brackets, hook and loop fasteners, clamps, etc. The particular means for fastening the adjoining panels in an upright condition is not a limitation of this invention.

To employ enclosure 10 for sunbathing or other outdoor applications, the user typically first lays out the enclosure in a flat, collapsed condition upon a selected underlying surface (e.g. the ground, a deck, etc.). Bottom panel 12 lies flat upon the underlying surface and the side and end panels extend outwardly therefrom and likewise lie flat upon the underlying surface. The user may then place a beach towel, lounge chair, etc. upon the underlying surface. The user next raises each of the side and end panels and fastened the adjoining panels together by means of fasteners 60 or otherwise. With enclosure 10 in a fully assembled condition, user U may lie upon a towel or mat placed within the enclosure, as shown in FIG. 3. The screening material 32 and 50 within each panel effectively guards the user's privacy. Privacy is maintained while the user sunbathes.

Figure 5:
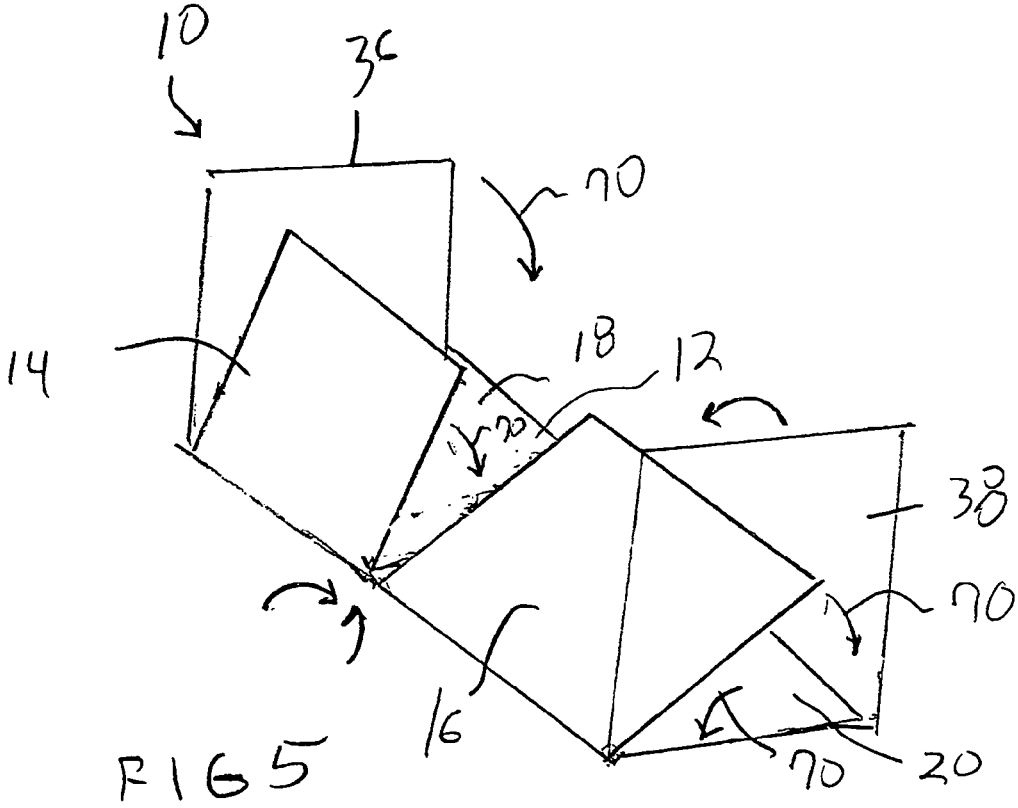
FIG. 5 is a simplified perspective view of the enclosure being collapsed into a compact condition.
Figure 6:
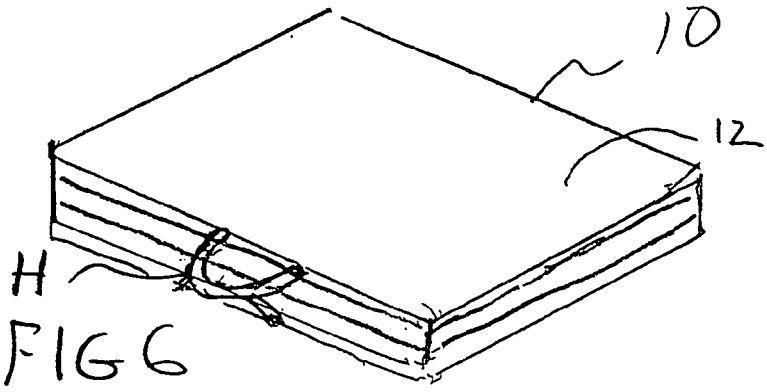
FIG. 6 is a perspective view of the enclosure after it has been fully collapsed and in a condition suitable to be transported.

After sunbathing is completed, enclosure 10 may be collapsed for transportation or storage in the manner shown in FIGS. 5 and 6. First, each of the fasteners 60 is disengaged. The side and end panels are then allowed to collapse or fold as indicated by arrows 70 in FIG. 5. More particularly, opposing side panels 14 and adjoining end panel 36 are stacked on one side of bottom panel 12. Opposing end panels 16 and 20 and adjoining end panel are similarly stacked upon the opposite end of the bottom panel. The precise order in which the side and end panels may be folded over may be varied within the scope of this invention. In any case, after the side and end panels are collapsed, the bottom panel is folded longitudinally in half (i.e. across a lateral fold line) so that a collapsed stack of panels is achieved in the manner shown in FIG. 6. Enclosure 10 effectively assumes the shape of a single square panel, with each of the individual side and end panels stacked upon one another. The bottom panel is effectively folded into two half sections, each of which has a size generally resembling the size of each side and end panel. The folded or collapsed panels may be secured together by Velcro™ fasteners, snap fasteners, straps or other means. A handle H may be attached to the panels in order to facilitate transportation of the collapsed enclosure. The handle may comprise a pair of U-shaped straps attached respectively to panels at the top and bottom of the stack. The handle may be composed of leather, plastic or other materials. As best shown in FIG. 6, the collapsed product assumes a compact shape that is conveniently portable and easy to store between uses.

It should be understood that enclosure 10 may have various dimensions within the scope of this invention. Typically, the length of the enclosure (i.e. the length of the adjoining pair of side panels 14, 16 and 18, 20 should be at least 6 feet so that an adult can lie comfortably head-to-toe between the end panels 36 and 38. The width may vary, although the enclosure should be at least approximately 3 feet wide so that the end panels 36 and 38 have a size generally comparable to each of the side panels. By utilizing a length that is approximately twice the width, the panels may feature like dimensions so that the panels are folded and stacked in a conforming, compact and convenient fashion. Closure and storage are thereby facilitated. Various alternative dimensions may be utilized within the scope of this invention.

The material comprising the frame may be varied. Wood, fiberglass, PVC, wire and alternative materials may be employed. In a like manner, the fabric forming the bottom panel and the obscuring material of the side and end panels may be altered. Canvas and an opaque mesh are preferred, although a wide variety of other materials (i.e. wood, flexible or rigid plastics, etc.) may be employed.

As previously stated, the privacy enclosure is not limited to use for sunbathing. It can alternatively be used for various other indoor and outdoor applications where the user requires privacy and wherein the portability of the apparatus is important.

Accordingly, the present invention provides for a collapsible, portable privacy enclosure and, more particularly, to a product featuring a plurality of releasably interconnected side walls that function as privacy panels and which are foldable into a conveniently transportable unit. While this detailed description has set forth particularly preferred embodiments of the apparatus of this invention, numerous modifications and variations of the structure of this invention, all within the scope of the invention, will readily occur to those skilled in the art. Accordingly, it is understood that this description is illustrative only of the principles of the invention and is not limitative thereof.

Although specific features of the invention are shown in some of the drawings and not others, this is for convenience only, as each feature may be combined with any and all of the other features in accordance with this invention.

Other embodiments will occur to those skilled in the art and are within the following

What is claimed is:

1. A portable privacy enclosure comprising:

a bottom panel for supporting a person thereon;

a first pair of side panels attached and independently foldable with respect to said bottom panel along a first longitudinal side thereof, said first pair of side panels being juxtaposed horizontally beside one another along said first longitudinal side of said bottom panel;

a second pair of side panels attached and independently foldable with respect to said bottom panel along an opposite second longitudinal side thereof, said second pair of side panels being juxtaposed horizontally beside one another along said second longitudinal side of said bottom panel;

a pair of end panels foldably attached to said bottom panel along respective forward and rearward ends thereof, each said end panel extending between said first and second longitudinal sides of said bottom panel; each side and end panel being foldable relative to said bottom panel independently of each other side and said bottom panel; and a plurality of fasteners for releasably securing said first pair of side panels to one another, said second pair of side panels to one another and each end panel to a respective one of said first pair and a respective one of said second pair of side panels such that said side and end panels are held vertically upright to surround said bottom panel;

said enclosure further including an open upper end that exposes an interior of said enclosure; each said side and end panel carrying an opaque screen that blocks viewing of the interior of said enclosure therethrough; said fasteners being selectively released to sequentially collapse said side and end panels onto said bottom panel in a stacked arrangement.

2. The privacy enclosure of claim 1 in which said bottom panel includes a flexible sheet.

3. The privacy enclosure of claim 2 in which said longitudinal sides of said bottom panel are longer than said respective first and second pairs of side panels and wherein each pair of side panels are aligned horizontally along a respective longitudinal side of said bottom panel and attached to said panel with an adjustable gap formed between said side panels, said bottom panel being selectively collapsed to close said gap and permit said side panels to interengage whereby said side panels may be releasably secured to one another.

4. The privacy enclosure of claim 2 in which said forward and rearward ends of said bottom panel are wider than said respective end panels and wherein an adjustable gap is formed between each end panel and each side panel to which said end panel is secured, said bottom panel being selectively folded to close said gap and permit said end panel to interengage said side panel such that said panels may be releasably secured to one another.

5. The privacy enclosure of claim 1 in which each of said side and end panels includes a peripheral frame to which said screen is attached, said screen extending fully across an interior opening of said frame.

6. The privacy enclosure of claim 5 in which said frame is rectangular and further including a gusset carried by each corner of said frame for strengthening said frame.

7. The privacy enclosure of claim 5 in which each screen includes a flexible opaque fabric that blocks viewing therethrough.

8. The privacy enclosure of claim 1 in which at least one of said fasteners includes a hook and loop connector assembly with a hook component carried by one of said panels and a complementary loop component carried by the other said panel.

9. The privacy enclosure of claim 1 in which each screen includes a flexible opaque fabric.

10. The privacy enclosure of claim 1 in which said bottom panel is folded with said side and end panels collapsed thereon to form a collapsed enclosure with said side and end panels arranged in a single stack.

11. The privacy enclosure of claim 10 in which said side and end panels are congruent.

12. The privacy enclosure of claim 10 in which at least one of said side and end panels carries a handle for enabling said enclosure to be carried when said panels are in a collapsed, single stack condition.

13. The privacy enclosure of claim 1 in which at least one of said fasteners includes a strap attached to one of said panels and a hole formed in the other said panel for interengaging said strap to secure said panels together.

14. The privacy enclosure of claim 1 in which said first pair of side panels are juxtaposed along respective vertically disposable side edges thereof and said second pair of side panels are juxtaposed along respective vertically disposable side edges thereof.

15. The privacy enclosure of claim 1 in which the juxtaposed first and second side panels are at least six feet long.

16. The privacy enclosure of claim 15 in which each side and end panel has a width of approximately three feet.

17. The privacy enclosure of claim 16 in which each side and end panel has a height that is sufficient for said panel to block viewing through said panel of an adult person in a prone position within said enclosure.

18. The privacy enclosure of claim 17 in which each side and end panel has a height of approximately three feet.

* * * * *